US005165868A

United States Patent [19]

Gergets et al.

[11] Patent Number: 5,165,868

[45] Date of Patent: Nov. 24, 1992

[54] MAGNETICALLY DRIVEN PUMP

[75] Inventors: Paul Gergets, Dyer, Ind.; Michael Mulcahy, Tinley Park, Ill.

[73] Assignee: Tuthill Corporation, Hinsdale, Ill.

[21] Appl. No.: 693,970

[22] Filed: Apr. 29, 1991

[51] Int. Cl.[5] ..... F04B 17/00

[52] U.S. Cl. ..... 417/366; 417/420

[58] Field of Search ..... 417/420, 366, 367

[56] References Cited

U.S. PATENT DOCUMENTS

| | | | |
|---|---|---|---|
| 3,238,878 | 3/1966 | Martin . | |
| 3,736,075 | 5/1973 | Otto | 417/370 |
| 4,013,384 | 3/1977 | Oikawa | 417/368 |
| 4,047,847 | 9/1977 | Oikawa | 417/370 |
| 4,065,235 | 12/1977 | Furlong et al. | 417/420 |
| 4,080,112 | 3/1978 | Zimmermann | 417/420 |
| 4,407,641 | 10/1983 | Long | 417/356 |
| 4,871,301 | 10/1989 | Buse | 417/366 |

*Primary Examiner*—Richard A. Bertsch
*Assistant Examiner*—Alfred Basichas
*Attorney, Agent, or Firm*—Lee, Mann, Smith, McWilliams, Sweeney & Ohlson

[57] ABSTRACT

A magnetically driven pump and drive mechanism having a rotary driving member with a recess therein and a first magnetic surface thereon, a rotary driven member located in the recess of the driving member and having a second magnetic surface on its periphery, a container located between the drive member and the driven member for preventing the escape of cooling fluids circulated therein, a hub connected to the rotary driven member, at least one port through the hub providing for the passage of fluid from the first side of the hub to the second side of the hub, and a gap between the driven member and the container which provides a second fluid passage between the first side of the hub and the second side of the hub. The port and gap combine to provide a fluid circulation path to allow constant fluid circulation between the first side of the hub and the second side of the hub, thereby cooling the rotary driven member.

9 Claims, 2 Drawing Sheets

MAGNETICALLY DRIVEN PUMP

BACKGROUND OF THE INVENTION

This invention relates to a magnetically driven pump and drive mechanism and an arrangement which allows for cooling of the rotary driven member.

The Environmental Protection Agency regulations have restricted the leakage of certain liquids from gear pumps. Commonly, contact with the environment occurs either by leakage into the pump or escape of liquid from the pump. Therefore, it is common to use gear pumps with sealed magnetically coupled drives. Such magnetically coupled drives eliminate drive shaft seals, which are a major source of pump leakage and contamination of the environment.

Generally, these types of pumps have a magnetic drive mechanism with a sealed housing separating the driving and driven members. A gap is provided between the driven member and the sealed container to allow for the passage of cooling fluid to the rear portion of the rotary driven member.

Such magnetic drive mechanisms are sensitive to temperatures seen along the magnetic drive and driven surfaces. The magnetic surfaces lose strength and efficiency as temperature increases. This problem is compounded because the magnetic surfaces also lose strength as the distance between the inner and outer magnetic surfaces increases. Thus, it is common to keep the distance between the inner and outer magnetic surfaces to a minimum. However, keeping this distance to a minimum reduces the size of the gap between the fluid containment canister and the rotary driven member. Such a reduction in the width of the gap severely restricts circulation of the cooling fluid to the back side of the inner magnetic surface, thus resulting in increased temperature of the magnetic surface and decreased drive efficiency.

SUMMARY OF THE INVENTION

The present invention overcomes the problems of restricted fluid circulation, increased magnetic surface temperature and decreased efficiency of prior art arrangements by providing ports through the hub of the driven member so as to provide a fluid passage to allow cooling fluid to pass through said hub, around the back side of the driven member and through the gap between the driven member and the container to allow for constant fluid circulation thereby cooling the driven member and its magnetic surface.

DETAILED DESCRIPTION OF THE PREFERRED EMBODIMENT

Figures 1, 2, 3:
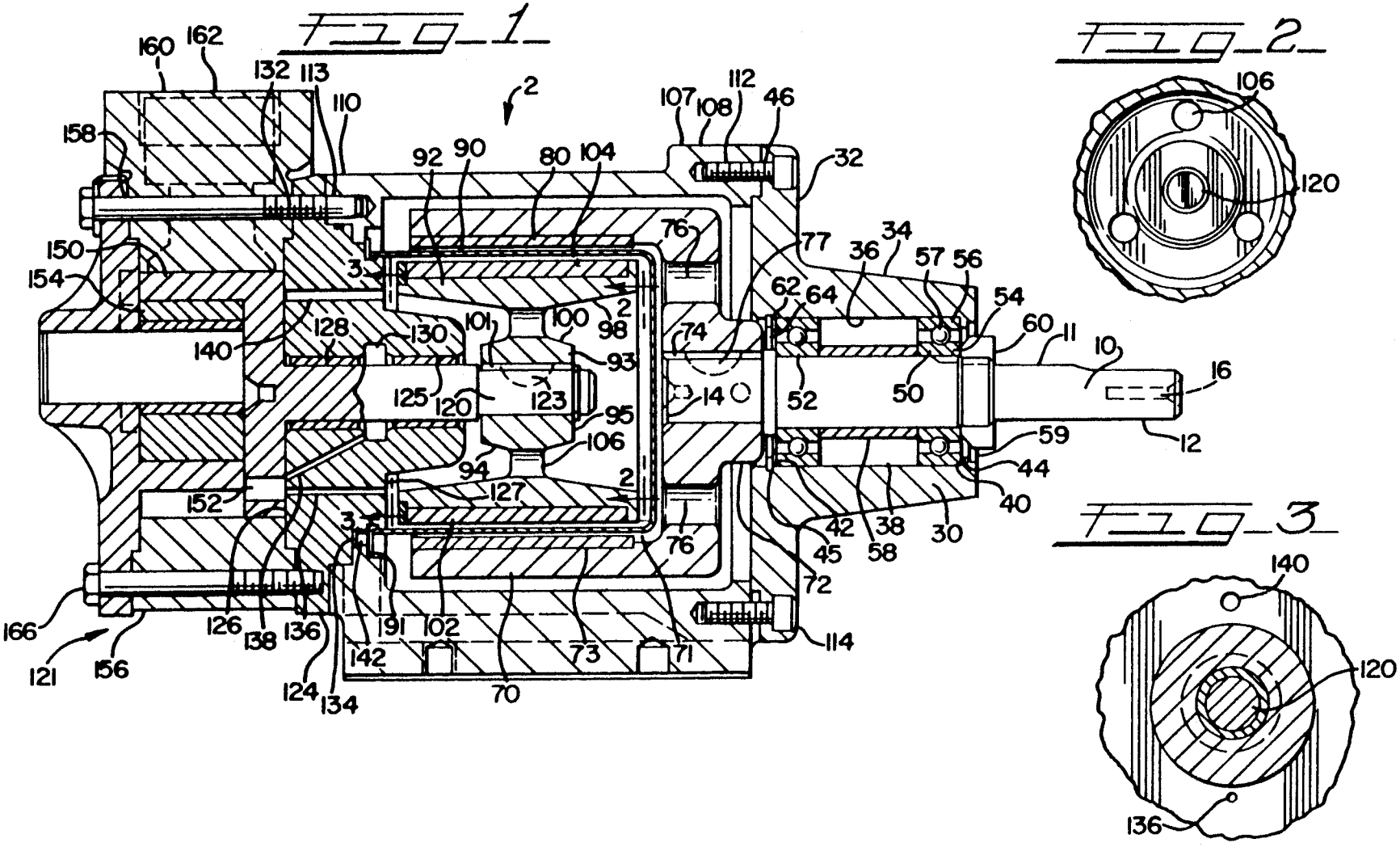
FIG. 1 is a cross section view, partially broken-away, of the pump and drive mechanism of the present invention.
FIG. 2 is an end view, taken along the line 2—2 in FIG. 1.
FIG. 3 is an end view, taken along the line 3—3 in FIG. 1.

The present invention is directed to a magnetically driven pump and drive mechanism generally depicted with the number 2. As shown in FIG. 1, the drive mechanism includes a shaft 10 adapted to be connected to an external power source. Shaft 10 includes a cylindrical outer surface 11 extending between a first end 12 and a second end 14. The first end 12 includes keyway 16, and the second end 14 includes a keyway (not shown). The drive mechanism also includes a bearing housing 30. The bearing housing 30 includes a flange 32 and a stem 34. A bore 36 includes a cylindrical wall 38 and extends through the stem 34 and the flange 32. The wall 38 has a first end 40 and a second end 42. A circular lip 44 extends from the wall 38 and into the bore 36 at the first end 40 of the wall 38. A circular recess 45 is formed in the wall 38 at the second end 42 of the wall 38. A plurality of apertures 46 are located in the flange 32.

The shaft 10 extends through the bore 36 of the bearing housing 30 and is supported by bearings 50 and 52. Each bearing 50 and 52 includes an inner race 54, an outer race 56 and a plurality of spherical balls 57. The inner race 54 of each bearing 50 and 52 is located against the wall 38 and the outer race 56 of bearing 50 is located against the circular lip 44. Positioned between the inner races 54 of bearings 50 and 52 is a spacer 58 which encircles the shaft 10 and provides for proper spacing of the bearings 50 and 52. A lock washer 59 is situated within the circular lip 44. A lock nut 60 is affixed on top of the lock washer 59 to position and lock the bearings 50 and 52 in place. A spring 62 is situated between bearing 52 and a retaining ring 64 at the second end 42 of the wall 38. This spring 62 is compressed and held in place by retaining ring 64. The spring 62 and retaining ring 64 also provide proper preload of the bearings 50 and 52 and retain the bearings 50 and 52 in place.

A cup shaped rotary drive member 70 with a recess 71 therein, includes a stem 72 which is attached to the second end 14 of the shaft 10. The rotary drive member 70 has an interior surface 73. A bore 74 extends through the stem 72 of the rotary drive member 70. A pair of apertures 76 extend through the rotary drive member 70. These apertures 76 reduce the weight of the rotary drive member 70 and provide other functions which will be discussed later. The shaft 10 extends into bore 74 and is affixed thereto by a woodruff key 77 or any of a number of other connections. A magnetic drive surface 80 which includes a series of magnets is attached to the interior surface 73 of the rotary drive member 70.

A thin containment can 90, which provides a sealed containment area for pump fluid, is disposed within the recess 71 in close proximity to the magnetic surface 80. A flange 91 extends around the open edge of the containment can 90 and provides an engagement surface. A rotary driven member 92 is rotatably disposed within the containment can 90. This driven member 92 includes a hub 93 which has a first side 94 and a second side 95. This hub 93 includes a flange 98 and an annular member 100 with a bore 101 therethrough. Attached to the periphery of the flange 98 is a magnetic driven surface 102. The dimensions of the hub 93, the magnetic surface 102 and the containment can 90 are arranged so that a gap 104 is formed between the magnetic surface 102 and the containment can 90. This gap generally ranges in dimension between 0.040 and 0.080 inches for most pump sizes. One or more ports 106 are provided through the hub 93 intermediate the flange 98 and the annular member 100. FIG. 2 shows three such ports but the number, size and arrangement of such ports are dependent upon the specifics likely to be incurred for the particular pump which is being driven.

The drive mechanism is enclosed by an adapter 107. The adapter 107 includes a first side 108 and a second side 110. A plurality of threaded apertures 112 are located in the first side 108 of the adapter 107. A plurality of apertures 113 are located in the second side 110 of the adapter 107. The adapter 107 is attached to the bearing housing 30 by screws 114 which extend through apertures 46 in the flange 32 of the bearing housing 30 and into the threaded apertures 112 located in the first side 108 of the adapter 107. An input shaft 120 of a gear pump 121 extends into the bore 101 in the annular member 100 of the hub 93, and is attached to the hub 93 by use of a key 123 and keyway arrangement. The rotary pump 121 can be of any type commonly known in the art. This rotary pump 121 illustrated in FIG. 1 includes a bracket 124 which has a bore 125 therethrough along the central axis of the bracket 124. The bracket 124 includes a first side 126 and a second side 127. A bushing 128 is located in the bore 125 through which the input shaft 120 extends. A recess 130 is formed in the bore 125. A plurality of threaded apertures 132 are located in the bracket 124. A circular recess 134 is formed in the bracket 124 at the second side 127 of the bracket 124. One or more vent passages 136 are illustrated extending from the first side 126 of the bracket 124 (the discharge side of the pump) to the second side 127 of the bracket 124. An additional vent passage 138 extends from the first side 126 of the bracket 124 to the recess 130 located in the bore 125. One or more vent passages 140 are illustrated extending from the first side 126 of the bracket 124 (the suction side of the pump) to the second side 127 of the bracket 124. The vent passages 136 on the discharge side of the rotary pump 121 must be smaller in diameter than the vent passages 140 on the suction side of the rotary pump 121 for proper pumping action.

The containment can 90 is attached to the second side 127 of the bracket 124 by the marginal flange 91 located at the open edge of the containment can 90 which compresses an o-ring 142 located in the circular recess 134 at the second side 127 of the bracket 124 to contain fluid within the can and prevent leakage to the environment.

The input shaft 120 of the rotary pump 121 is attached to drive the outer gear 150 which is located within a chamber 152. An inner gear 154 engages the outer gear 150 in conventional manner.

A housing 156 is attached to the first side 127 of the bracket 124. The housing includes a plurality of apertures 158, an inlet port 160 and an outlet port 162. Screws 166 extend through apertures 158 and into threaded apertures 132 and 113 and hold the pump housing 156, the bracket 124 and the adapter 110 together.

The operation of the magnetically driven pump and drive mechanism 2 as shown in FIGS. 1-3 will now be explained. Energization of a power source rotates shaft 10, to which it is connected, and the rotary drive member 70 with the magnetic surface 80 attached thereto. The magnetic attraction between surfaces 80 and 102 causes rotation of the driven member 92 in a well known manner and thus causes rotation of input shaft 120. The rotation of the input shaft 120 rotates the outer gear 150 of the rotary pump 121. Rotation of the outer gear 150 produces a pumping action in a well known manner and pressurizes fluid within the chamber 152.

Fluid enters the rotary pump 121 via inlet port 160. The chamber 152 through the outer gear 150 allows for the transmission of pressurized fluid to vent passages 136 and 138. Vent passage 138 transmits fluid to recess 130 and bushing 128 thereby providing lubrication for the input shaft 120. Vent passage 136 transmits fluid to the interior of the containment can 90. This fluid is circulated from the first side 94 of the hub 93 to the second side 95 of the hub through the ports 106 and returns to the front side 94 of the hub 93 via the gap 104. The fluid in the interior of the containment can 90 is then returned to the rotary pump by vent passage 140 which transmits fluid from the second side 127 of the bracket 124 to the chamber 152 in the outer gear 150. This chamber 152 thereby transfers the pump fluid to the outlet port 162 of the rotary pump 121.

This invention thereby allows for direct fluid access to the back of the driven magnetic surface 102 via ports 106 and recirculation through the gap 104. Without the ports 106 the flow is restricted and the temperature at the back of the magnetic surface 102 rises. With the ports 106 the temperature across the magnetic surface 104 remains cooler and more uniform and drive efficiency is increased.

Figure 4:
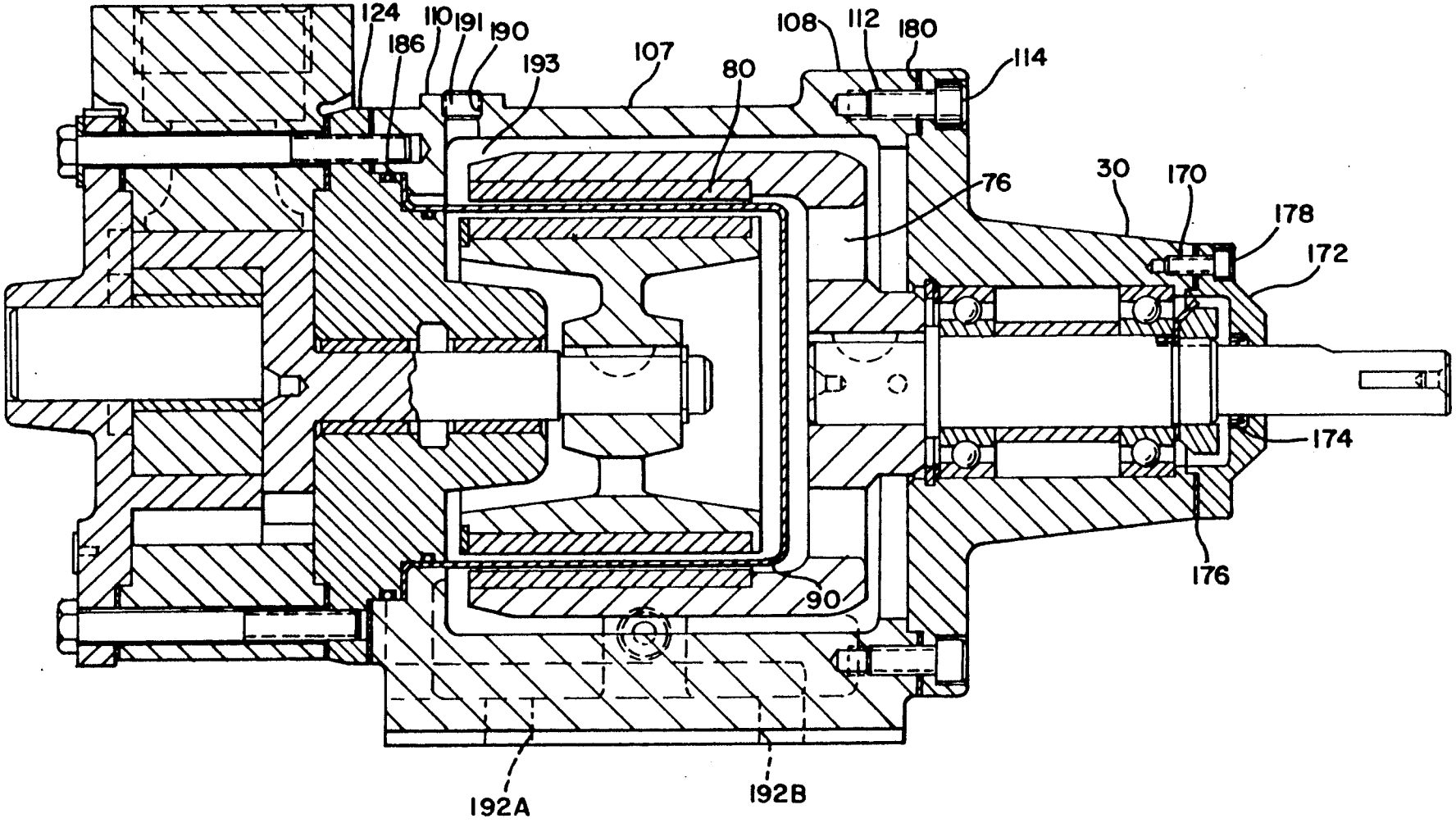
FIG. 4 is a cross section view, partially broken away, of the pump and drive mechanism of an embodiment of the present invention.

A modified embodiment of the pump and drive mechanism of the present invention is shown in FIG. 4. This embodiment incorporates a secondary containment option which provides additional protection against leakage to the environment in the event that the containment can 90 is punctured or develops a leak in any manner. The pump and drive mechanism illustrated in FIG. 4 includes all of the basic elements of the arrangement illustrated in FIGS. 1-3 with some additional sealing features.

A plurality of apertures 170 are located at the rear of the bearing housing 30. A cap 172 is secured to the bearing housing 30 and a seal is provided surrounding the shaft 10 via a lip seal arrangement 174. A gasket 176 is located between the bearing housing 30 and the cap 172. This gasket 176 provides a seal when screws 178 are used to attach the cap 172 to the bearing housing 30. A gasket 180 is positioned between the first side 108 of the adapter 107 and the bearing housing 30 to provide a seal when screws 114 are threaded into apertures 112. An o-ring 186 provides an additional seal between the second side 110 of the adapter 107 and the bracket 124.

A port 190 is provided in the upper face of the adapter 107 which can be sealed by a pipe plug 191 when not in use. A pair of ports 192A and 192B (shown in phantom) are provided in the lower face of the adapter 107. The port 190 provides a means for the entry of cooling fluid from an external source (such as a second pump not shown) to a cavity 193 formed between the adapter 107 and the containment can 90. Apertures 76 allow for the circulation of cooling fluid to the back portion of the magnetic drive surface 80 in a manner similar to that described for the embodiment of FIGS. 1-3. The cooling fluid then exists the cavity 193 via the ports 192. These ports 192 can also be closed with pipe plugs (not shown) to prevent accidental leakage to the environment when such a flushing arrangement is not employed.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed:

1. A magnetic pump drive mechanism including a housing; a rotary drive member consisting of a cup shaped element defining a recess therein; a first magnetic surface carried by said drive member positioned in said housing; a rotary driven member disposed for rotation in said recess of said rotary drive member; a second magnetic surface carried by said driven member and positioned adjacent to said first magnetic surface; a container having a peripheral wall member with inner and outer surfaces disposed between said drive member and said driven member; a source of cooling fluid in communication with the interior of said container; a hub forming part of said rotary driven member; at least one port defined through said hub to provide a first fluid passage from a first side of said hub to a second side of said hub; a gap defined between said driven member and said inner surface of said peripheral wall member of said container said gap defining a second fluid passage between a first side of said hub and a second side of said hub whereby said port and said gap combine to produce a first fluid circulation path interior to said container to allow for constant fluid circulation between said first side of said hub and said second side of said hub through said port and said gap thereby providing cooling of said rotary driven member; a fluid inlet port defined in said housing adapted to be connected to a source of cooling fluid; a gap defined between said rotary drive member and said outer peripheral surface of said container, said gap defining a second fluid circulation path, exterior to said container, to allow for fluid circulation across said second magnetic surface of said rotary drive member thereby providing cooling of said rotary drive member and a fluid outlet port defined in said housing adapted to carry cooling fluid from said housing.

2. A magnetic pump drive mechanism as in claim 1 including a plurality of ports defined through said hub each said port providing a fluid passage from a first side of said hub to a second side of said hub.

3. A magnetic pump drive mechanism as in claim 1 in which said rotary driven member is drivingly connected to an input shaft of a rotary gear pump.

4. A magnetically driven rotary gear pump including a housing defining a chamber therein and including a fluid inlet, a fluid outlet and a fluid sump; a rotary gear pump means disposed within said housing adapted to receive fluid from said inlet, to pressurize said fluid and to expel said fluid from said outlet; an input shaft connected to said gear pump means for operation thereof; a hub connected to said input shaft for rotation therewith; a sealed container surrounding said hub for containment of liquid therein said container having a peripheral wall member with inner and outer surfaces; first and second fluid vent passages positioned between said pump chamber and said container for circulation of fluid therebetween said first vent passage positioned between the suction side of said pump and said container, said second vent passage positioned between the discharge side of said pump and said container, said first vent passage being of greater cross-sectional diameter than said second vent passage; at least one port defined through said hub to provide a first fluid passage from a first side of said hub to a second side of said hub; a first magnetic surface disposed on the outer periphery of said hub and located interiorly of said sealed container; a gap defined between said magnetic surface and said sealed container which defines a second fluid passage between said first side of said hub and said second side of said hub such that said port and said gap combine to produce a first fluid circulation path to allow for constant fluid circulation between said first side of said hub and said second side of said hub through said port and said gap thereby providing for cooling of said first magnetic surface.

5. A magnetically driven rotary gear pump as in claim 4 including a plurality of ports defined through said hub each said port providing a fluid passage from a first side of said hub to a second side of said hub.

6. A magnetically driven rotary gear pump as in claim 4 including a rotary drive member carrying a second magnetic surface positioned outside of said container and adjacent said first magnetic surface.

7. A magnetically driven rotary gear pump as in claim 6 wherein said rotary drive member includes at least one aperture defined through said rotary drive member.

8. A magnetic pump drive mechanism as in claim 1 wherein said rotary drive member includes at least one aperture defined through said rotary drive member.

9. A magnetically driven gear pump as in claim 6 including a housing surrounding said first and second magnetic surfaces; a fluid inlet port defined in said housing adapted to be connected to a source of cooling fluid; a gap defined between said rotary drive member and said outer peripheral surface of said container, said gap defining a second fluid circulation path, exterior to said container, to allow for fluid circulation across said second magnetic surface of said rotary drive member thereby providing cooling of said rotary drive member and a fluid outlet port defined in said housing adapted to carry cooling fluid from said housing.

* * * * *